US009508286B2

(12) United States Patent
Sun

(10) Patent No.: US 9,508,286 B2
(45) Date of Patent: Nov. 29, 2016

(54) PIXEL CIRCUIT, DISPLAY SUBSTRATE AND DISPLAY DEVICE

(71) Applicant: BOE TECHNOLOGY GROUP CO., LTD., Beijing (CN)

(72) Inventor: Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 163 days.

(21) Appl. No.: 14/445,213

(22) Filed: Jul. 29, 2014

(65) Prior Publication Data

US 2015/0279273 A1 Oct. 1, 2015

(30) Foreign Application Priority Data

Mar. 27, 2014 (CN) ..... 2014 1 0119639

(51) Int. Cl.
*G09G 3/32* (2016.01)

(52) U.S. Cl.
CPC .... *G09G 3/3233* (2013.01); *G09G 2300/0852* (2013.01)

(58) Field of Classification Search
CPC ..... G09G 3/3233
See application file for complete search history.

(56) References Cited

U.S. PATENT DOCUMENTS

2008/0001859 A1* 1/2008 Byun ..... G09G 3/3233 345/76

FOREIGN PATENT DOCUMENTS

| | | |
|---|---|---|
| CN | 103198793 A | 7/2013 |
| CN | 203288219 U | 11/2013 |
| CN | 203502926 U | 3/2014 |

OTHER PUBLICATIONS

Chinese Office Action dated Jul. 29, 2015 issued in corresponding Chinese Application No. 201410119639.1 along with English translation.

* cited by examiner

*Primary Examiner* — Michael Faragalla
*Assistant Examiner* — Chayce Bibbee
(74) *Attorney, Agent, or Firm* — Nath, Goldberg & Meyer; Joshua B. Goldberg; Leonid D. Thenor

(57) ABSTRACT

The present invention provides a pixel circuit, a display substrate and a display device. The pixel circuit comprises a control section, a light emitting diode, a high-level input terminal, a low-level input terminal and a reference terminal, in which the control section comprises a driving thin film transistor, at least one capacitors and a plurality of switching thin film transistors. The reference terminal is connected with the low-level input terminal so as to discharge a capacitor which is connected with a gate of the driving thin film transistor in a pixel resetting stage of the pixel circuit.

9 Claims, 1 Drawing Sheet

PIXEL CIRCUIT, DISPLAY SUBSTRATE AND DISPLAY DEVICE

FIELD OF THE INVENTION

The present invention relates to the field of display technology, and particularly relates to a pixel circuit, a display substrate comprising the pixel circuit and a display device comprising the display substrate.

BACKGROUND OF THE INVENTION

The working procedure of the pixel circuit in an organic light emitting display device comprises three stages. The first stage is a pixel resetting stage, in which the reference terminal of the pixel circuit is connected to a low level so as to discharge the gate of the driving transistor. The second stage is a data writing stage, in which the storage capacitor is discharged. The third stage is a light emitting stage, in which power is supplied to the light emitting device.

The electric level required in the pixel resetting stage is provided by the pixel circuit itself, which results in higher driving voltage of the pixel circuit.

Therefore, a technical problem to be solved in the art is how to reduce the power consumption of the display device.

SUMMARY OF THE INVENTION

A target of the invention is to provide a pixel circuit, a display substrate comprising the pixel circuit, and a display device comprising the display substrate. The display device has small power consumption.

To achieve the above target, according to an aspect of the invention, provided is a pixel circuit comprising a control section, a light emitting diode, a high-level input terminal, a low-level input terminal and a reference terminal, in which the control section comprises a driving thin film transistor, at least one capacitors and a plurality of switching thin film transistors, a cathode of the light emitting diode is connected with the low-level input terminal, the driving thin film transistor is connected between the light emitting diode and the high-level input terminal, and a gate of the driving thin film transistor, one of the capacitors, one of the switching thin film transistors and the reference terminal are connected with each other in this order, wherein the reference terminal is connected with the low-level input terminal so as to discharge the capacitor connected with the gate of the driving thin film transistor in a pixel resetting stage of the pixel circuit.

Preferably, the plurality of the switching thin film transistors include a first thin film transistor a second thin film transistor, a third thin film transistor, a fourth thin film transistor, and a fifth thin film transistor, and the at least one capacitors include a first capacitor and a second capacitor;

the first thin film transistor is connected between the gate of the driving thin film transistor and a drain of the driving thin film transistor, a gate of the first thin film transistor is connected with a second control signal terminal;

the third thin film transistor is connected between the drain of the driving thin film transistor and an anode of the light emitting diode, a gate of the third thin film transistor is connected with a first control signal terminal;

the fifth thin film transistor is connected between the reference terminal and one end of the second capacitor, a gate of the fifth thin film transistor is connected with the second control signal terminal;

the second thin film transistor and the fourth thin film transistor are connected in series between the high-level input terminal and a data signal input terminal, a gate of the second thin film transistor is connected with the first control signal terminal, a gate of the fourth thin film transistor is connected with the second control signal terminal; and one end of the first capacitor is connected between the second thin film transistor and the fourth thin film transistor, the other end of the first capacitor is connected to the end of the second capacitor, and the other end of the second capacitor is connected with the gate of the driving thin film transistor.

Preferably, in the pixel resetting stage of the pixel circuit, a first control signal outputted from the first control signal terminal and a second control signal outputted from the second control signal terminal are in low level;

in a data writing stage of the pixel circuit, the first control signal is in high level, the second control signal is in low level; and in a light emitting stage of the pixel circuit, the first control signal is in low level, the second control signal is in high level.

According to another aspect of the invention, provided is a display substrate comprising a pixel circuit, characterized in that, the pixel circuit is the above pixel circuit provided by the invention.

According to another aspect of the invention, provided is a display device comprising a display substrate, wherein the display substrate is the above display substrate provided by the invention.

In the pixel circuit provided by the invention, since the reference terminal is always connected with the low-level input terminal, the low-level required for pixel resetting may be provided to the reference terminal by an external DC power via the low-level input terminal instead of by the pixel circuit itself in the pixel resetting stage. Thereby, the driving voltage required for the pixel circuit may be reduced, and as a result, the power consumption of the pixel circuit may also be reduced.

BRIEF DESCRIPTION OF THE DRAWINGS

The drawings which constitute a part of the description are provided for the understanding of the present invention, and for explaining the present invention in conjunction with the following embodiments while not for limiting the scope of the invention, in which.

DETAILED DESCRIPTION OF THE EMBODIMENTS

Hereinafter, the embodiments of the invention will be described in detail with reference to the drawings. It will be understood that the specific embodiments described herein are provided for explaining the invention, not for limiting the invention.

Figure 1:
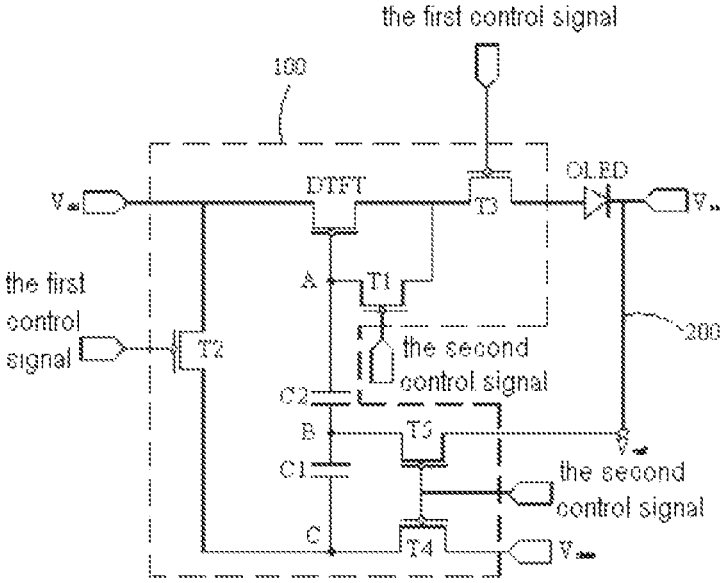
FIG. 1 is a circuit diagram of an embodiment of the pixel circuit provided by the invention.

As shown in FIG. 1, an aspect of the invention provides a pixel circuit which comprises a control section 100, a light emitting diode OLED, a high-level input terminal $V_{dd}$, a low-level input terminal $V_{ss}$ and a reference terminal $V_{ref}$. The control section 100 comprises a driving thin film transistor DTFT, at least one capacitors and a plurality of switching thin film transistor. The cathode of the light emitting diode OLED is connected to the low-level input terminal $V_{ss}$. The driving thin film transistor DTFT is connected between the light emitting diode OLED and high-level input terminal $V_{dd}$, and the gate of the driving thin film transistor DTFT, one of the capacitors, one of the switching thin film transistors and the reference terminal $V_{ref}$ are connected with each other in this order. The reference terminal $V_{ref}$ is connected to the low-level input terminal $V_{ss}$ so as to discharge the capacitor connected to the gate of the driving thin film transistor DTFT during the pixel reset stage of the pixel circuit. In FIG. 1, the reference terminal $V_{ref}$ is connected to the low-level input terminal $V_{ss}$ by a metal conductor 200.

It will be understood that the control section 100 functions to cause the pixel circuit works in the pixel rest stage, the data writing stage and the light emitting stage normally.

In the pixel circuit provided by the invention, when displaying is implemented by using a display device comprising the above-mentioned pixel circuit, the low-level input terminal $V_{ss}$ is connected to a DC power supply which is externally connected to the pixel circuit, so as to input a low level into the light emitting diode OLED.

Since the reference terminal $V_{ref}$ is always connected to the low-level input terminal $V_{ss}$, the low level required for resetting the pixel may be supplied to the reference terminal $V_{ref}$ during the pixel resetting stage from the external DC power source via the low-level input terminal $V_{ss}$, instead of by the pixel circuit itself. Consequently, the driving voltage required by the pixel circuit may be reduced, and thereby the power consumption of the pixel circuit may also be reduced.

For example, in the prior art, as for a display device with WVGA resolution, if the reset capacitance for the pixel circuit is 0.5 pF, the average reset potential is 6V, and the refresh rate is 60 frame, then the power consumption P of the pixel circuit is:

$$P = \frac{480 \times 800 \times 3 \times 0.5\ \text{pF} \times 6V \times 60/s \times 6V}{2} = 0.622\ \text{mW}$$

In the pixel circuit of the present invention, the resetting voltage required during the pixel resetting stage is supplied to the pixel circuit by the external DC power source. Thus, the power consumption P will not occur in the pixel circuit. It can be seen that with the pixel circuit of the present invention, the power consumption of the pixel circuit is reduced while the stability of the resetting voltage is ensured.

Further, with the pixel circuit of the present invention, the internal resistance (IR) drop of a display device comprising such pixel circuit when displaying is performed by the display device can be reduced.

In the prior art, the square resistance of the cathode of the organic light emitting diode is typically 10Ω/□ to 30Ω/□. Thus, in the existing pixel circuit, the voltage difference between the highest potential and the lowest potential in the organic light emitting diode resulted from the internal resistance of the organic light emitting diode is larger than 1.5V.

Figure 2:
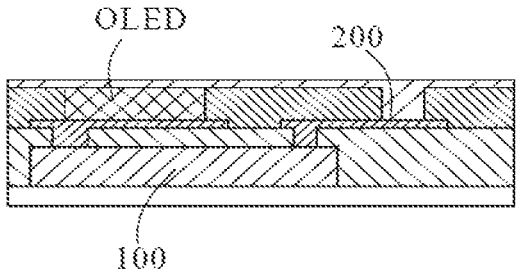
FIG. 2 is a schematic diagram of sectional view of the display substrate provided by the invention.

In the pixel circuit of the present invention, connecting the reference terminal $V_{ref}$ to the low-level input terminal $V_{ss}$ is equivalent to the fact that the metal conductor 200 for connecting the reference terminal $V_{ref}$ to the low-level input terminal $V_{ss}$ is connected with the light emitting diode OLED in parallel (as shown in FIG. 2). The resistivity of the metal conductor is typically 0.4Ω·cm. Thus, by connecting the reference terminal $V_{ref}$ to the low-level input terminal $V_{ss}$, the voltage difference between the highest potential and the lowest potential in the light emitting diode OLED is reduced to lower than 0.3V. Thereby, the driving voltage of the pixel circuit may be reduced by about 1V, and the power consumption of the pixel circuit is further reduced.

In the embodiment illustrated in FIG. 1, the plurality switching thin film transistors include a first thin film transistor T1, a second thin film transistor T2, a third thin film transistor T3, a fourth thin film transistor T4 and a fifth thin film transistor T5, and the at least one capacitors include a first capacitor C1 and a second capacitor C2.

As shown in FIG. 1, the first thin film transistor T1 is connected between the gate and the drain of the driving thin film transistor DTFT. The gate of the first thin film transistor T1 is connected to a second control signal terminal.

The third thin film transistor T3 is connected between the drain of the driving thin film transistor DTFT and the anode of the light emitting diode OLED. The gate of the third thin film transistor T3 is connected to a first control signal terminal.

The fifth thin film transistor T5 is connected between the reference terminal $V_{ref}$ and one end of the second capacitor C2. The gate of the fifth thin film transistor T5 is connected to a second control signal terminal.

The second thin film transistor T2 and the fourth thin film transistor T4 are connected in series between the high-level input terminal $V_{dd}$ and a data signal input terminal $V_{data}$. The gate of the second thin film transistor T2 is connected to the first control signal terminal. The gate of the fourth thin film transistor T4 is connected to the second control signal terminal.

One end of the first capacitor C1 is connected between the second thin film transistor T2 and the fourth thin film transistor T4, the other end of the first capacitor C1 is connected to the end of the second capacitor C2 which is connected with the fifth thin film transistor T5, and the other end of the second C2 is connected to the gate of the driving thin film transistor DTFT.

It will be understood that, a first control signal is outputted from the first control signal terminal, a second control signal is outputted from the second control signal terminal, and a data signal $V_{data}$ is supplied by the data signal input terminal.

During the pixel resetting stage of one display cycle, the first control signal is in low level, the second control signal is in low level, and the data signal $V_{data}$ is in low level. In this case, the first thin film transistor T1, the second thin film transistor T2, the third thin film transistor T3, the fourth thin film transistor T4 and the fifth thin film transistor T5 are all turned on. Since the first thin film transistor T1 is turned on, the driving thin film transistor DTFT is in a diode-connected state. The drain voltage of the driving thin film transistor DTFT is $V_{dd}+V_{th}$, wherein $V_{dd}$ is a voltage inputted from the high-level input terminal $V_{dd}$, and $V_{th}$ is the threshold voltage of the driving thin film transistor DTFT itself. At the end of the pixel resetting stage, the potential of point A is up to $V_{dd}+V_{th}$, the potential of point B is equal to the voltage of the reference terminal, i.e., the potential of point B is equal to the potential provided by the low-level input terminal $V_{ss}$, so that the second capacitor C2 is discharged; and the potential of point C is $V_{dd}$.

During the data writing stage of one display cycle, the first control signal is in high level, the second control signal is in low level, and the data signal $V_{data}$ is in high level. In this stage, the first thin film transistor T1, the fourth thin film transistor T4 and the fifth thin film transistor T5 are turned on, and the second thin film transistor T2 and the third thin film transistor T3 are turned off. Since the first thin film transistor T1 connected between the gate and the drain of the driving thin film transistor DTFT is turned on, the driving thin film transistor DTFT is still in the diode-connected state, and the potential of the point A is maintained. Since the fifth thin film transistor T5 is turned on, the potential at the common connection point B between the first capacitor C1 and the second capacitor C2 is equal to the potential provided by the low-level input terminal $V_{ss}$. Since the second thin film transistor T2 is turned off and the fourth thin film transistor T4 is turned on, the potential at the common connection point C between the second thin film transistor T2 and the first capacitor is equal to $V_{data}$. Thus, both the first and the second capacitors C1 and C2 are in charging state.

During the light emitting stage of one display cycle, the first control signal is in low level, the second control signal is in high level, and the data signal $V_{data}$ is in low level. In this case, the first thin film transistor T1, the fourth thin film transistor T4 and the fifth thin film transistor T5 are turned off, and the second thin film transistor T2 and the third thin film transistor T3 are turned on. Since the second thin film transistor T2 is turned on, the potential at the common connection point C between the second thin film transistor T2 and the first capacitor C1 is equal to $V_{dd}$. Since the fifth thin film transistor T5 is turned off, the first capacitor C1 and the second capacitor C2 shares a same electrode. Thereby, the potential of the point B is raised to $V_{ref}+V_{dd}-V_{data}$, while the potential of the point A is raised to $2V_{dd}+V_{th}-V_{data}$. At this time, with respect to the driving thin film transistor DTFT, the voltage difference between its gate and drain is $V_{gs}=V_{dd}+V_{th}-V_{data}$, thus the driving thin film transistor DTFT is in saturation state and the light emitting diode OLED is supplied with power, wherein the current I outputted for power supplying is:

$$I = \frac{1}{2}\beta(V_{gs} - V_{th})^2 = \frac{1}{2}\beta(V_{dd} + V_{th} - V_{data} - V_{th})^2 = \frac{1}{2}\beta(V_{dd} - V_{data})^2$$

Thus, the current in the light emitting diode OLED is unrelated to the threshold voltage of the driving thin film transistor DTFT. Accordingly, the driving current of the light emitting diode OLED may be stable, and the uniformity of the luminance of the display device is improved.

Another aspect of the invention provides a display substrate comprising the above pixel circuit of the invention.

Still another aspect of the invention provides a display device comprising the above display substrate of the invention. As stated above, since the pixel circuit of the invention needs smaller driving voltage, its power consumption is low, thereby the power consumption of the display device of the invention is also low.

In the invention, the display device may be a display device such as a mobile telephone, a tablet PC, and so on.

It may be understood that the foregoing embodiments are examples only for explaining the principle of the invention. The present invention is not limited to those. It is apparent to a person skilled in the art that various modifications and improvements may be made without departing from the scope of the invention, which should be deemed as falling into the protective scope of the invention.

The invention claimed is:

1. A pixel circuit comprising a control section, a light emitting diode, a high-level input terminal, a low-level input terminal and a reference terminal, in which the control section comprises a driving thin film transistor, at least one capacitors and a plurality of switching thin film transistors, a cathode of the light emitting diode is connected with the low-level input terminal, the driving thin film transistor is connected between the light emitting diode and the high-level input terminal, and a gate of the driving thin film transistor, one of the capacitors, one of the switching thin film transistors and the reference terminal are connected with each other in this order, the pixel circuit is characterized in that the reference terminal is connected with the low-level input terminal so as to discharge the capacitor connected with the gate of the driving thin film transistor in a pixel resetting stage of the pixel circuit.

2. The pixel circuit according to claim 1, wherein the plurality of the switching thin film transistors includes a first thin film transistor, a second thin film transistor, a third thin film transistor, a fourth thin film transistor, and a fifth thin film transistor, and the at least one capacitors include a first capacitor and a second capacitor;

the first thin film transistor is connected between the gate of the driving thin film transistor and a drain of the driving thin film transistor, a gate of the first thin film transistor is connected with a second control signal terminal;

the third thin film transistor is connected between the drain of the driving thin film transistor and an anode of the light emitting diode, a gate of the third thin film transistor is connected with a first control signal terminal;

the fifth thin film transistor is connected between the reference terminal and one end of the second capacitor, a gate of the fifth thin film transistor is connected with the second control signal terminal;

the second thin film transistor and the fourth thin film transistor are connected in series between the high-level input terminal and a data signal input terminal, a gate of the second thin film transistor is connected with the first control signal terminal, a gate of the fourth thin film transistor is connected with the second control signal terminal; and one end of the first capacitor is connected between the second thin film transistor and the fourth thin film transistor, the other end of the first capacitor is connected to the end of the second capacitor, and the other end of the second capacitor is connected with the gate of the driving thin film transistor.

3. The pixel circuit according to claim 2, wherein, in the pixel resetting stage of the pixel circuit, a first control signal outputted from the first control signal terminal and a second control signal outputted from the second control signal terminal are in low level;

in a data writing stage of the pixel circuit, the first control signal is in high level, the second control signal is in low level; and in a light emitting stage of the pixel circuit, the first control signal is in low level, the second control signal is in high level.

4. A display substrate comprising a pixel circuit, characterized in that the pixel circuit is the pixel circuit according to claim 1.

5. The display substrate according to claim 4, wherein, in the pixel circuit, the plurality of the switching thin film transistors include a first thin film transistor, a second thin film transistor, a third thin film transistor, a fourth thin film transistor, and a fifth thin film transistor, and the at least one capacitors include a first capacitor and a second capacitor;

the first thin film transistor is connected between the gate of the driving thin film transistor and a drain of the driving thin film transistor, a gate of the first thin film transistor is connected with a second control signal terminal;

the third thin film transistor is connected between the drain of the driving thin film transistor and an anode of the light emitting diode, a gate of the third thin film transistor is connected with a first control signal terminal;

the fifth thin film transistor is connected between the reference terminal and one end of the second capacitor, a gate of the fifth thin film transistor is connected with the second control signal terminal;

the second thin film transistor and the fourth thin film transistor are connected in series between the high-level input terminal and a data signal input terminal, a gate of the second thin film transistor is connected with the first control signal terminal, a gate of the fourth thin film transistor is connected with the second control signal terminal; and one end of the first capacitor is connected between the second thin film transistor and the fourth thin film transistor, the other end of the first capacitor is connected to the end of the second capacitor, and the other end of the second capacitor is connected with the gate of the driving thin film transistor.

6. The display substrate according to claim 5, wherein, in the pixel resetting stage of the pixel circuit, a first control signal outputted from the first control signal terminal and a second control signal outputted from the second control signal terminal are in low level;

in a data writing stage of the pixel circuit, the first control signal is in high level, the second control signal is in low level; and in a light emitting stage of the pixel circuit, the first control signal is in low level, the second control signal is in high level.

7. A display device comprising a display substrate, characterized in that the display substrate is the display substrate according to claim 4.

8. The display device according to claim 7, wherein, in the pixel circuit of the display substrate, the plurality of the switching thin film transistors include a first thin film transistor, a second thin film transistor, a third thin film transistor, a fourth thin film transistor, and a fifth thin film transistor, and the at least one capacitors include a first capacitor and a second capacitor;

the first thin film transistor is connected between the gate of the driving thin film transistor and a drain of the driving thin film transistor, a gate of the first thin film transistor is connected with a second control signal terminal;

the third thin film transistor is connected between the drain of the driving thin film transistor and an anode of the light emitting diode, a gate of the third thin film transistor is connected with a first control signal terminal;

the fifth thin film transistor is connected between the reference terminal and one end of the second capacitor, a gate of the fifth thin film transistor is connected with the second control signal terminal;

the second thin film transistor and the fourth thin film transistor are connected in series between the high-level input terminal and a data signal input terminal, a gate of the second thin film transistor is connected with the first control signal terminal, a gate of the fourth thin film transistor is connected with the second control signal terminal; and one end of the first capacitor is connected between the second thin film transistor and the fourth thin film transistor, the other end of the first capacitor is connected to the end of the second capacitor, and the other end of the second capacitor is connected with the gate of the driving thin film transistor.

9. The display substrate according to claim 8, wherein, in the pixel resetting stage of the pixel circuit, a first control signal outputted from the first control signal terminal and a second control signal outputted from the second control signal terminal are in low level;

in a data writing stage of the pixel circuit, the first control signal is in high level, the second control signal is in low level; and in a light emitting stage of the pixel circuit, the first control signal is in low level, the second control signal is in high level.

* * * * *